United States Patent [19]

Hutter

[11] 4,180,301

[45] Dec. 25, 1979

[54] COAXIAL CABLE CONNECTOR

[75] Inventor: Harold G. Hutter, Brookfield, Conn.

[73] Assignee: Bunker Ramo Corporation, Oak Brook, Ill.

[21] Appl. No.: 886,854

[22] Filed: Mar. 15, 1978

[51] Int. Cl.[2] ..... H01R 13/54

[52] U.S. Cl. ..... 339/90 C; 339/88 R; 339/177 E

[58] Field of Search ..... 339/177 E, 184 M, 186 M, 339/91 P, 88 R, 90 C, 94 C; 179/88 C

[56] References Cited

U.S. PATENT DOCUMENTS

| | | | |
|---|---|---|---|
| 2,656,203 | 10/1953 | Musser | 287/76 |
| 2,729,800 | 1/1956 | Knudsen | 339/88 C X |
| 2,761,111 | 8/1956 | Klostermann | 339/91 |
| 2,785,384 | 3/1957 | Wickesser | 339/90 C |
| 3,101,984 | 8/1963 | Wieckmann | 339/69 |
| 3,101,986 | 8/1963 | Lyman | 339/255 |
| 3,154,360 | 10/1964 | Plishner | 339/88 |
| 3,323,083 | 5/1967 | Ziegler | 333/97 |
| 3,439,294 | 4/1969 | Flanagan et al. | 339/33 |
| 3,519,975 | 7/1970 | Prow et al. | 339/14 |
| 3,681,739 | 8/1972 | Kornick | 339/94 C |
| 3,954,321 | 5/1976 | Casper | 339/177 R |
| 3,985,418 | 10/1976 | Spinner | 339/177 R |

FOREIGN PATENT DOCUMENTS

| | | |
|---|---|---|
| 885093 | 11/1971 | Canada . |
| 647335 | 12/1950 | United Kingdom . |
| 755159 | 8/1956 | United Kingdom . |
| 913657 | 12/1962 | United Kingdom . |
| 933229 | 8/1963 | United Kingdom . |
| 1154181 | 6/1969 | United Kingdom . |
| 1266952 | 3/1972 | United Kingdom . |
| 1306032 | 2/1973 | United Kingdom . |
| 1385330 | 2/1975 | United Kingdom . |
| 1397861 | 6/1975 | United Kingdom . |

*Primary Examiner*—E. F. Desmond

*Attorney, Agent, or Firm*—William Lohff; F. M. Arbuckle

[57] ABSTRACT

A connector for joining ends of a pair of cables is disclosed. The connector includes first and second connector members each having a mating end with the mating end of the first connector member having an opening to receive the mating end of the second connector member. Means associated with the mating ends of the first and second connector members are provided for orienting the connector members for mating engagement. The orientation means permits the mating end of the first connector member to receive the mating end of the second connector member only in a preselected position of relative rotation. Means associated with the mating ends of the first and second connector members are also provided for securing the connector members in locked engagement. The orientation means provides an entryway leading to the securing means to permit locked engagement of the connector members with the securing means following mating engagement with the orientation means. The connector also includes resilient retaining means serving to resist forces tending to move the connector members out of locked engagement and providing an environmental seal. With these features of construction, the connector provides for self-alignment and positive locking in a low cost, light weight, weatherproof construction.

23 Claims, 9 Drawing Figures

COAXIAL CABLE CONNECTOR

BACKGROUND OF THE INVENTION

The present invention relates to a connector typically useful for joining ends of a pair of cables and, more particularly, to a connector of the type described having cooperatively related self-alignment and positive locking features.

In recent years, the need for new and different connector constructions has significantly increased. This is attributable to a number of factors not the least of which are the vagaries of the marketplace. It is commonly known that many types of electrical equipment requiring electrical connectors are becoming even more popular. For instance, the sale of Citizens' Band radios on a large scale to consumers in recent years compelled a commensurate development of CB connectors, adapters, etc. It led to the development of various "UHF" connectors primarily of the screw-on or push/pull type. These connectors were usually rather expensive to manufacture and difficult to install with the exception of the push/pull type that were easy to install but did not provide positive locking. While expense and installation were not insignificant considerations, the principal focus was on the accessory CB market for automobile and home use where the various "UHF" connectors proved satisfactory.

For several years, the market for Citizens' Band radios for installation particularly in automobiles remained strong. The principal suppliers were primarily selling directly to the consumer through retail outlets. Prices of such equipment were initially relatively high and the expense of the various "UHF" connectors was relatively minor in comparison therewith for the typical under-dash installation of a Citizens' Band radio on a mounting bracket attached to the dashboard of the consumer's automobile. The principal suppliers in the future will probably not be selling directly to the consumer through retail outlets. Due to saturation of the market, the focus will instead be upon in-dash factory installation of Citizens' Band radios as accessories in new cars by the automobile manufacturers.

Since the automobile manufacturers will control this entire segment of the marketplace, they are interested in an automobile CB connector of low cost. It will also be important for the plug and jack of such a connector to have self-alignment features to limit installation time. This is particularly true for in-dash factory installations where assembly line techniques are employed. It is contemplated that the plug and jack of such a connector will have to be aligned behind the dash without the benefit of visual observation. Accordingly, low cost automobile CB connectors which can be mated by tactile means will be highly desirable.

Moreover, the automobile manufacturers will require an automobile CB connector which is highly reliable. It is well known, of course, that any connector used in this environment must be capable of withstanding the vibrations normally associated with automobiles. Positive locking is therefore desirable if not essential particularly for a Citizens' Band radio connector which will be disposed behind the dashboard in the case of in-dash factory installations. It is also well known, of course, that any connector used in this environment should be weatherproof to prohibit the entry of the elements normally associated with automobiles. As a result, low cost automobile CB connectors which provide weatherproof positive locking will also be highly desirable.

Finally, the automobile manufacturers today are ever increasingly conscious not only of the cost but also the weight of all components. This applies from the largest components to the smallest almost without exception. It is easy to understand the economic considerations mandating an effort to reduce costs, but it is also fundamental why weight is also so critical. This derives from the necessity to reduce fuel consumption which can be done directly by reducing weight. Hence, connectors suitable for in-dash factory installation of Citizens' Band radios should ideally combine self-alignment and positive locking in a low cost, light weight, weatherproof construction.

SUMMARY OF THE INVENTION

Accordingly, the present invention, in its broadest aspect, is directed to an improved connector comprising first and second connector members each having a mating end with the mating end of the first connector member having an opening to receive the mating end of the second connector member. Means associated with the mating ends of the first and second connector members are provided for orienting the connector members for mating engagement. Means associated with the mating ends of the first and second connector members are also provided for securing the connector members in locked engagement. The orientation means provides an entryway leading to the securing means to permit locked engagement of the connector members with the securing means following mating engagement with the orientation means. With these features of construction, a connector is provided having self-alignment and positive locking in a low cost, light weight, weatherproof construction.

More particularly, the orientation means preferably includes cooperatively shaped elements associated with the mating ends of the first and second connector members limiting mating engagement of the connector members to a preselected position of relative rotation. The securing means also advantageously includes cooperatively shaped elements associated with the mating ends of the first and second connector members limiting locked engagement of the connector members to a preselected position of relative rotation. The securing means further advantageously permits locked engagement only after the mating end of the second connector member has been fully inserted into the opening in the mating end of the first connector member following mating engagement of the orientation means. Additionally, the orientation means preferably permits relative movement between the connector members in a first direction along the entryway with the securing means permitting relative movement between the connector members in a second direction out of the entryway.

In a more specific embodiment, the present invention is directed to a connector for joining ends of a pair of cables. The orientation means again permits the mating end of the first connector member to receive the mating end of the second connector member only in a preselected position of relative rotation. The connector can also include indexing means providing a non-visual indication of full insertion of the mating end of the second connector member into the opening in the mating end of the first connector member following mating engagement of the connector members with the orientation means. The indexing means includes resilient contact or retaining means associated with the mating end of one of the connector members which serves to resist forces tending to move the connector members out of locked engagement.

Additional features of this embodiment preferably include the mating ends of the first and second connector members each being defined by outer surfaces generally cylindrical in shape with the mating end of the second connector member being dimensioned to fit within the opening in the mating end of the first connector member. The opening in the mating end of the first connector member is also advantageously defined by an inner surface generally cylindrical in shape with the opening having an inner diameter at least as great as the outer diameter of the mating end of the second connector member. With these features of construction, the securing means permits locked engagement of the connector members only after the mating end of the second connector member has been fully inserted into the opening in the mating end of the first connector member following mating engagement of the connector members with the orientation means.

Considering the orientation means in somewhat more detail, it preferably includes a projection associated with the mating end of one of the connector members and an axially extending interruption associated with the mating end of the other of the connector members. The projection is suitably a shoulder and the axially extending interruption is suitably a shoulder accommodating surface with the shoulder and the shoulder accommodating surface permitting axial mating engagement of the connector members in at least one preselected position of relative rotation. The securing means also advantageously includes a projection associated with the mating end of one of the connector members and a circumferential interruption associated with the mating end of the other of the connector members. The projection is again suitably the shoulder of the orientation means and the circumferential interruption is suitably a shoulder accommodating groove with the shoulder and the shoulder accommodating groove permitting rotational locking engagement of the connector members in at least one preselected position of relative rotation. In addition, the orientation means prevents rotational locking engagement of the connector members until the mating end of the second connector member has been fully inserted into the opening in the mating end of the first connector member following axial mating engagement of the connector members with the orientation means.

The entryway is defined by the shoulder accommodating surface which terminates in and communicates with the shoulder accommodating groove with the shoulder accommodating groove being longitudinally positioned to permit rotational locking engagement only in a position of full axial mating engagement. The shoulder is associated with the inner surface defining the opening in the mating end of the first connector member and the shoulder accommodating surface is associated with the outer surface of the mating end of the second connector member.

In a still more specific embodiment, the present invention is directed to a connector for joining ends of a pair of coaxial cables each having an inner conductor surrounded by an insulating layer, an outer conductor, and an insulating jacket. The connector includes first and second connector members each having a conductive body with the bodies of the first and second connector members each having a mating end and a cable receiving end. The cable receiving ends of the connector members are each adapted to receive the end of the inner conductor of one of the cables in electrical isolation therefrom. Means are provided for electrically connecting the ends of the inner conductors of the pair of coaxial cables in electrical isolation from the bodies of the first and second connector members and means are also provided for electrically connecting the ends of the outer conductors of the pair of coaxial cables in electrical contact with the bodies of the first and second connector members. The mating end of the first connector member has an opening to receive the mating end of the second connector member and the mating end of the second connector member has an opening to communicate with the cable receiving end of the first connector member. Means associated with the mating ends of the first and second connector members are provided for orienting the connector members for mating engagement and means associated with the mating ends of the first and second connector members are also provided for securing the connector members in locked engagement. The securing means permits locked engagement of the connector members only after the mating end of the second connector member has been fully inserted into the opening in the mating end of the first connector member following mating engagement of the connector members with the orientation means.

Other features can closely parallel the details discussed above in connection with more general embodiments. It is also contemplated that the inner conductor electrical connection means preferably includes a spring contact disposed in the opening in the mating end of the second connector member with the contact having axially aligned jaws at opposite ends thereof. It is further contemplated that the inner conductor electrical connection means advantageously includes a hollow dielectric plug disposed in the opening in the mating end of the second connector member with the spring contact being disposed within the dielectric plug in electrical isolation from the bodies of the first and second connector members. Still other features include the cable receiving ends of the first and second connector members each having means for securing the corresponding one of the ends of the pair of cables to be joined and each communicating with the corresponding one of the mating ends of the first and second connector members.

With respect to further features of the inner conductor electrical connection means, the dielectric plug preferably has axially aligned openings in opposite ends thereof which are also axially aligned with the jaws of the spring contact. The cable receiving ends of the first and second connector members then advantageously have bores therethrough which are each dimensioned to receive the inner conductor and the insulating layer of the ends of one of the pair of coaxial cables to be joined. The cable receiving ends of the first and second connector members with bores therethrough permit the inner conductors associated with the connector members to extend into the openings in the mating ends thereof to be electrically connected by means of the spring contact. As a result, the inner conductor associated with the second connector member is gripped by one of the jaws of the spring contact and the inner conductor associated with the first connector member is releasably gripped by the other of the jaws of the spring contact in a fully mated condition.

The present invention is therefore directed in its broadest sense to a connector having both means for orienting connector members for mating engagement and means for securing connector members in locked engagement. This is accomplished by providing structure in which the orientation means provides an entryway leading to the securing means to permit locked engagement of the connector members with the securing means following mating engagement with the orientation means. The connector of the present invention therefore meets the objective of having both self-alignment and positive locking features in a single device. This is also accomplished with structure which is capable of low cost, light weight and weatherproof construction well suited for a wide variety of applications including use as an automobile CB connector. Still other objects and advantages of the present invention will be appreciated from a consideration of the details of construction and operation set forth in the accompanying specification, claims and drawings.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings. In the drawings, like reference numerals identify like elements in the several figures, in which:

DETAILED DESCRIPTION OF THE PREFERRED EMBODIMENT

Figure 1:
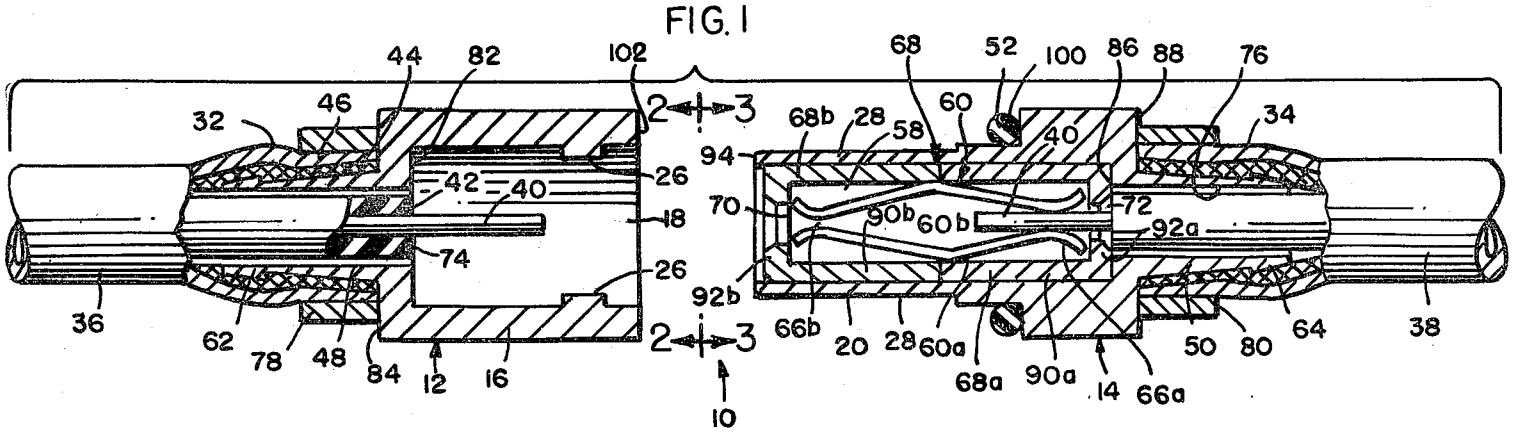
FIG. 1 is a cross-sectional view of first and second connector members of a connector constructed in accordance with the present invention.
Figure 3:
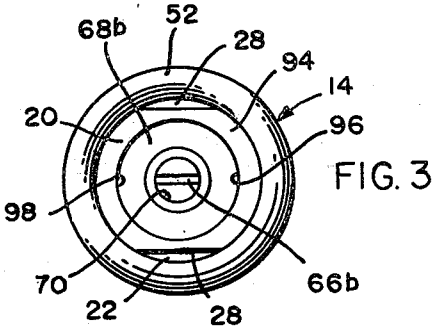
FIG. 3 is a cross-sectional view taken on the line 3—3 of FIG. 1.
Figure 2:
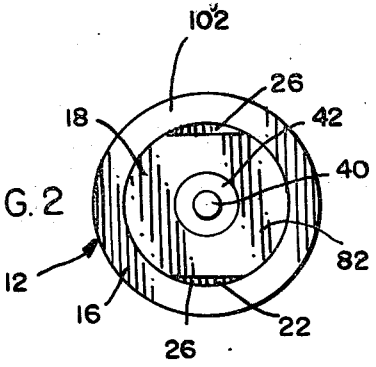
FIG. 2 is a cross-sectional view taken on the line 2—2 of FIG. 1.
Figures 4, 5, 6, 7, 8:
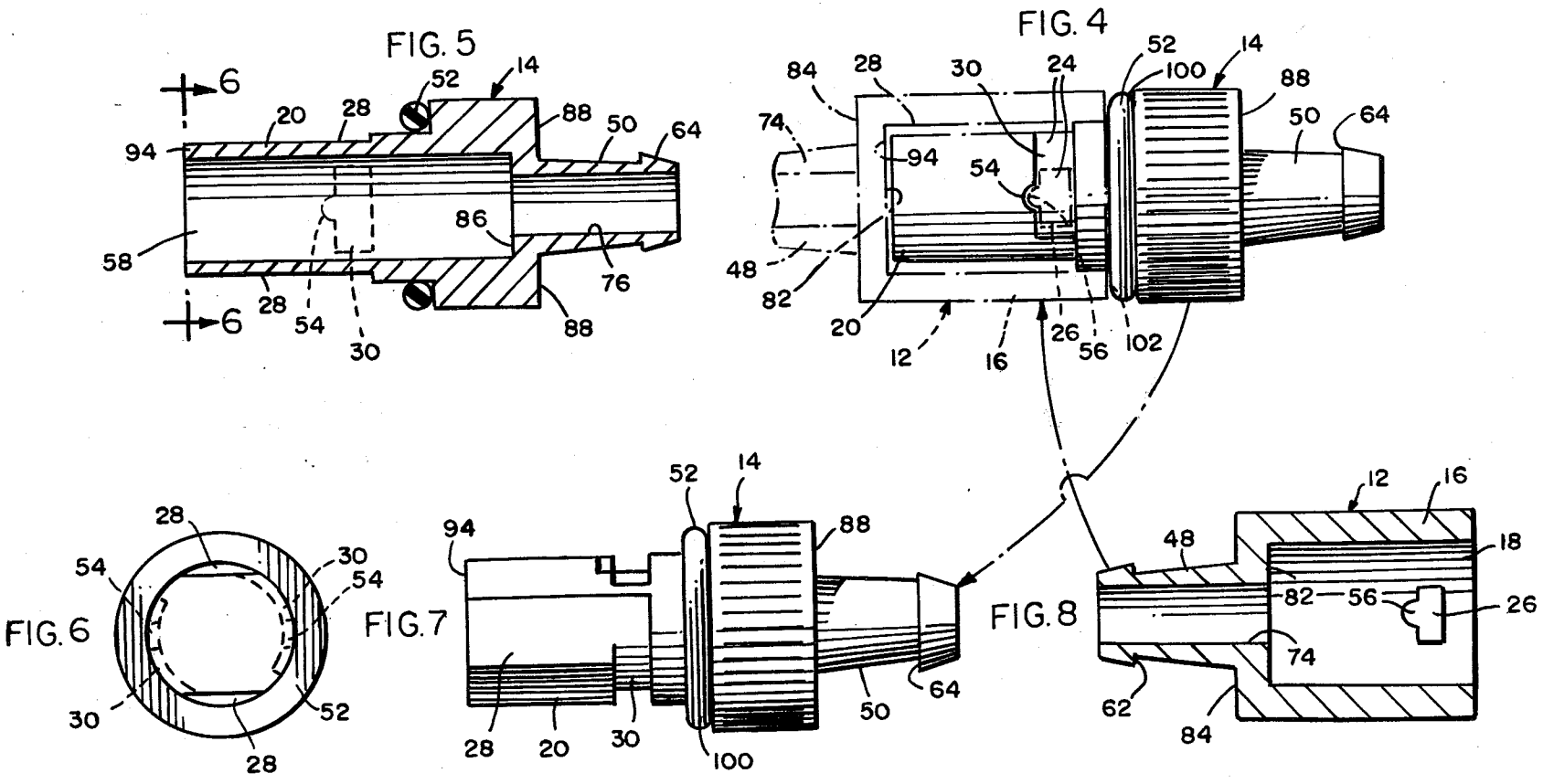
FIG. 4 is a front elevational view partially in phantom of first and second connector members illustrating locked engagement of the connector members.
FIG. 5 is a cross-sectional view of the second connector member of a connector constructed in accordance with the present invention.
FIG. 6 is a cross-sectional view taken on the line 6—6 of FIG. 5.
FIG. 7 is a side elevational view of the second connector member of a connector constructed in accordance with the present invention.
FIG. 8 is a cross-sectional view of the first connector member of a connector constructed in accordance with the present invention.

In the illustration given and with reference first to FIG. 1, the reference numeral 10 designates generally a connector in accordance with the present invention. The connector includes first and second connector members 12 and 14, respectively, each having a mating end with the mating end 16 of the first connector member or plug 12 having an opening 18 to receive the mating end 20 of the second connector member or jack 14. Means 22 associated with the mating ends 16 and 20 of the first and second connector members 12 and 14 (as shown in FIGS. 2 and 3) are provided for orienting the connector members for mating engagement thereof. Means 24 associated with the mating ends 16 and 20 of the first and second connector members 12 and 14 (as shown in FIG. 4) are also provided for securing the connector members in locked engagement thereof. The orientation means 22 provides an entryway leading to the securing means 24 to permit locked engagement of the first and second connector members 12 and 14 with the securing means 24 following mating engagement thereof with the orientation means 22. With these features of construction, the connector 10 is characterized by both self-alignment and positive locking features which cooperate in a manner permitting low cost, light weight, weatherproof construction in a manner to be described in greater detail hereinafter.

Referring to FIGS. 2 and 3, it will be seen that the orientation means 22 includes cooperatively shaped elements 26 and 28 associated with the mating ends 16 and 20, respectively, of the first and second connector members 12 and 14 limiting mating engagement of the connector members to a preselected position of relative rotation. The securing means 24 likewise includes cooperatively shaped elements 26 and 30 (as shown in FIGS. 4, 5, 6 and 7) associated with the mating ends 16 and 20, respectively, of the first and second connector members 12 and 14 limiting locked engagement of the connector members to a preselected position of relative rotation. The securing means 24 permits locked engagement (as shown in FIG. 4) only after the mating end 20 of the second connector member 14 has been fully inserted into the opening 18 in the mating end 16 of the first connector member 12 following mating engagement with the orientation means 22. From the above, it will be apparent that the orientation means 22 permits relative movement between the first and second connector members 12 and 14 in a first direction along the entryway defined by the element 28 and the securing means 24 permits relative movement between the first and second connector members 12 and 14 in a second direction out of the entryway defined by the element 28.

It will be seen from FIG. 1 that the connector 10 is particularly well suited for joining the ends 32 and 34 of a pair of cables 36 and 38, respectively. The cables illustrated are coaxial cables of the type characteristically used with Citizens' Band radios having an inner conductor 40 surrounded by an insulating layer 42, an outer conductor 44, and an insulating jacket 46. The first and second connector members 12 and 14 each have for this purpose a conductive body. The cables illustrated are secured to the bodies of the first and second connector members 12 and 14 at cable receiving ends 48 and 50 thereof. Additional features of construction of the cable receiving ends 48 and 50 of the connector members 12 and 14 will be discussed in greater detail hereinafter.

Referring again to FIGS. 2 and 3, the mating ends 16 and 20 of the first and second connector members 12 and 14 are each defined by an outer surface generally cylindrical in shape. The mating end 20 of the second connector member 14 is dimensioned to fit within the opening 18 in the mating end 16 of the first connector member 12 and, more particularly, the opening 18 has an inner diameter at least as great as the outer diameter of the mating end 20 of the second connector member 14. As will be appreciated, the opening 18 in the mating end 16 of the first connector member 12 is defined by an inner surface generally cylindrical in shape as well.

The cooperatively shaped elements 26 and 28 of the orientation means 22 (as shown in FIGS. 1 through 3) preferably take the form of one or more projections 26 associated with the mating end 16 of the first connector member 12 and a corresponding number of axially extending interruptions 28 associated with the mating end 20 of the second connector member 14. It will be appreciated by those skilled in the art, however, that the projections 26 could be associated with the second connector member 14 and the axially extending interruptions 28 could be associated with the first connector member 12 by using mere design expedients to accomplish the same objective. In any event, the projections 26 are preferably shoulders and the axially extending interruptions 28 are preferably shoulder accommodating surfaces cooperatively related so as to permit axial mating engagement of the connector members in at least one preselected position of relative rotation.

The cooperatively shaped elements 26 and 30 of the securing means 24 similarly include one or more projections 26 associated with the mating end 16 of the first connector member 12 and a corresponding number of circumferential interruptions 30 associated with the mating end 20 of the second connector member 14. It will again be appreciated by those skilled in the art that the projections 26 can be associated with the second connector member 14 and the circumferential interruptions 30 can be associated with the first connector member 12 to accomplish the same objective once again by using mere design expedients. In any event, the projections 26 are preferably the same shoulders comprising a portion of the orientation means 22 and the circumferential interruptions 30 are shoulder accommodating grooves cooperatively related to the shoulders so as to permit rotational locking engagement of the connector members in at least one preselected position of relative rotation.

Referring to FIGS. 1 and 7, the orientation means 22 prevents rotational locking engagement of the first and second connector members 12 and 14 until the mating end 20 of the second connector member 14 has been fully inserted into the opening 18 in the mating end 16 of the first connector member 12 following axial mating engagement of the connector members with the orientation means. The shoulder accommodating surfaces 28 thereby define the entryway referenced above which terminates in and communicates with the shoulder accommodating groove 30 and the shoulder accommodating groves 30 are longitudinally positioned along the mating end 20 of the second connector member 14. This results in rotational locking engagement being possible only when the connector members are relatively positioned as described. The shoulders 26 are preferably associated with the inner surface defining the opening 18 in the mating end 16 of the first connector member 12 and the shoulder accommodating surfaces 28 are preferably associated with the outer surface of the mating end 20 of the second connector member 14. However, the shoulders 26 could be associated with the outer surface of the mating end 20 of the second connector member 14 and the shoulder accommodating surfaces 28 could be associated with the inner surface defining the opening 18 in the mating end 16 of the first connector member 12 in the manner described hereinabove.

It will be appreciated from FIG. 2 that the generally cylindrical inner surface defining the opening 18 in the mating end 16 of the first connector member 12 defines a major dimension and the shoulders 26 define a minor dimension and the generally cylindrical outer surface of the mating end 20 of the second connector member 14 (as shown in FIG. 3) similarly defines a major dimension and the shoulder accommodating surfaces 28 similarly define a minor dimension. The first and second connector members 12 and 14 are adapted for mating engagement when the major and minor dimensions of the first connector member 12 are aligned, respectively, with the major and minor dimensions of the second connector member 14. As shown in FIGS. 6 and 7, the shoulder accommodating grooves 30 extend circumferentially on the mating end 20 of the second connector member 14 from the minor dimension portion or shoulder accommodating surface 28 into the major dimension portion or generally cylindrical outer surface and the shoulder accommodating grooves 30 have depths sufficient to receive the minor dimension portion or shoulder 26 of the mating end 16 of the first connector member 12.

Figure 1A:
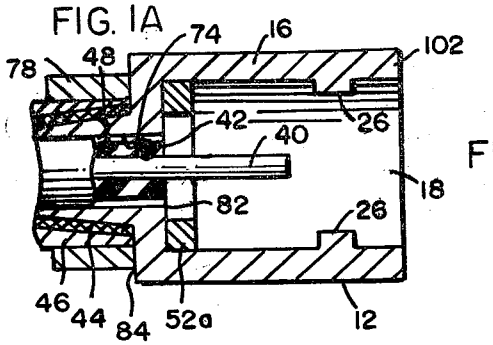
FIG. 1*a* is a cross-sectional view of an alternative embodiment of a first connector member of a connector constructed in accordance with the present invention.

The securing means 24 (as shown in FIG. 4) further includes resilient contact or retaining means 52 associated with the mating end 20 of the second connector member 12. The resilient retaining means 52 is provided to resist forces such as vibrations or the like tending to move the connector members 12 and 14 out of locked engagement creating a weatherproof environmental seal as well. An alternative form of resilient retaining means **52*a* is shown in FIG. 1*a* which is associated with the mating end 16 of the first connector member 12 rather than with the mating end 20 of the second connector member 14. The resilient retaining means 52 or 52*a* also provides an indexing means giving a non-visual, tactile, indication of full insertion of the mating end 20 of the second connector member 14 into the opening 18 in the mating end 16 of the first connector member 12. Preferably, the shoulder accommodating grooves 30 each include an indentation 54 and the shoulders 26 each include a rib 56 which fits within the corresponding indentation 54 when the connector members 12 and 14 are in locked engagement in which case the resilient retaining means 52 or 52*a* serves to maintain the rib 56 in the indentation 54**.

Considering the features of construction utilized in the connector 10 for joining the ends 32 and 34 of a pair of coaxial cables 36 and 38, the cable receiving end 48 of the first connector member 12 is adapted to receive the end of the inner conductor 40 of the cable 36 in electrical isolation therefrom. It will be seen and appreciated from FIG. 1 that the inner conductor 40 of the cable 36 actually extends into the opening 18 in the mating end 16 of the first connector member 12 and, similarly, the inner conductor 40 of the cable 38 extends into an opening 58 in the mating end 20 of the second connector member 14. The cable receiving end 50 of the second connector member 14 is also adapted to receive the end of the inner conductor 40 of the cable 38 in electrical isolation therefrom.

Referring to FIG. 1, the opening 58 in the mating end 20 of the second connector member 14 includes means 60 for electrically connecting the ends of the inner conductors 40 of the pair of coaxial cables 36 and 38 in electrical isolation from the bodies of the first and second connector members 12 and 14. Additionally, the cable receiving ends 48 and 50 of the first and second connector members 12 and 14, respectively, include means 62 and 64 for electrically connecting the ends of the outer conductors 44 of the pair of coaxial cables 36 and 38 in electrical contact with the bodies of the first and second connector members 12 and 14.

The cable receiving ends 48 and 50 of the first and second connector members 12 and 14 communicate with the corresponding one of the mating ends 16 and 20. The outer conductor electrical connection means 62 and 64 each preferably take the form of a barb bitingly engaging the corresponding one of the ends of the outer conductors 44 of the cables 36 and 38. Since the bodies of the connector members 12 and 14 are conductive, the barbs 62 and 64 assure electrical contact therebetween. The inner conductor electrical connection means 60 includes the spring contact 60 disposed in the opening 58 in the mating end 20 of the second connector member 14 with axially aligned jaws 66*a* and 66*b* at opposite ends thereof. In order to assure that the ends of the inner conductors 40 of the cables 36 and 38 are maintained in electrical isolation from the bodies of the first and second connector members 12 and 14, the spring contact 60 is disposed within a hollow dielectric plug 68.

Referring again to FIG. 1, the dielectric plug 68 has axially aligned openings 70 and 72 in opposite ends thereof which are also axially aligned with the jaws 66*a* and 66*b* of the spring contact 60. The cable receiving ends 48 and 50 of the first and second connector members 12 and 14 have bores 74 and 76 therethrough which are dimensioned to receive the corresponding ends of the inner conductors 40 and the insulating layers 42 of the cables 36 and 38 thereby also helping to maintain the inner conductors 40 in electrical isolation from the bodies of the first and second connector members 12 and 14. The inner conductors 40 associated with the cable receiving ends 48 and 50 of the first and second connector members 12 and 14 extend into the openings 18 and 58 in the mating ends 16 and 20 thereof with the inner conductor 40 associated with the second connector member 14 being gripped by the jaw 66*a* of the spring contact 60 and the inner conductor 40 associated with the first connector member 12 being releasably gripped by the jaw 66*b* of the spring contact 60 after full insertion of the mating end 20 of the second connector member 14 into the opening 18 in the mating end 16 of the first connector member 12.

Referring again to FIG. 1, the cables 36 and 38 are secured to the cable receiving ends 48 and 50 of the first and second connector members 12 and 14 by means of crimp rings 78 and 80. The cable receiving ends 48 and 50 are essentially identical in structure permitting the use of identical crimp rings 78 and 80 and also permitting the use of identical stripping dimensions, i.e., the inner conductors 40, insulating layers 42, outer conductors 44, and insulating jackets 46 of the cables 36 and 38 are stripped in identical fashion. It will be appreciated by those skilled in the art that after the cables 36 and 38 have been properly stripped, the inner conductors 40 and the insulating layers 42 of the cables 36 and 38 are inserted, respectively, into the bores 74 and 76 through the cable receiving ends 48 and 50 of the first and second connector members 12 and 14 until the inner conductors 40 extend into the openings 18 and 58 in the mating ends 16 and 20 thereof and the insulating layers 42 are flush with the inner rear walls 82 and 86 of the mating ends 16 and 20 thereof. The outer conductors 44 and the insulating jackets 46 are stretched over the cable receiving ends 48 and 50 as this is being done until they abut the outer rear walls 84 and 88 of the mating ends 16 and 20 thereof and the crimp rings 78 and 80 are moved along the cables 36 and 38 until they too abut the outer rear walls 84 and 88 of the mating ends 16 and 20 thereof. It will be further appreciated by those skilled in the art that the crimp rings 78 and 80 will then be crimped about the outer conductors 44 and the insulating jackets 46 of the cables 36 and 38 holding them tightly in position in cooperation with the barbs 62 and 64 after which the connector 10 will be ready for use with the cables 36 and 38 firmly and precisely in position.

With respect to the construction of the first and second connector members 12 and 14, they can be die cast of zinc alloy to achieve the objective of providing an effective low cost, light weight, weatherproof connector 10. The first connector member or plug 12 is suitably a single integral piece. It will be appreciated that the body of the second connector member 14 is likewise a single integral piece. The second connector member 14 will also include, however, the resilient retaining means or O-ring 52, the spring contact 60, and the hollow dielectric plug 68. With these three additional components, the second connector member 14 can easily be assembled in a manner providing assurance that all components will remain properly placed.

Referring to FIGS. 1 and 3, the hollow dielectric plug 68 preferably includes two identical plug portions or sleeves 68*a* and 68*b*. These plug portions or sleeves 68*a* and 68*b* include annular walls 90*a* and 90*b* terminating in end plates or discs 92*a* and 92*b* which are apertured as at 70 and 72, respectively, and the openings 70 and 72 are beveled to facilitate entry of the inner conductors 40 of the cables 36 and 38 into the spring contact 60. These plug portions or sleeves 68*a* and 68*b* are used by sliding the plug portion or sleeve 68*a* in the opening 58 with the apertured end plate or disc 92*a* thereof in abutment with the inner rear wall 86 and sliding the plug portion or sleeve 68*b* with the apertured end plate or disc 92*b* adjacent the front edge 94 of the mating end 20 of the second connector member 14. Of course, the spring contact 60 will be properly placed within this opening 58 in the mating end 20 of the second connector member 14 prior to insertion of the plug portion or sleeve 68*b*.

The plug portion or sleeve 68*b* is then held in position by stakes or inwardly directed protrusions 96 and 98. It has been found that two stakes or protrusions diametrically opposed are sufficient to hold the hollow dielectric plug 68 within the opening 58 in the mating end 20 of the second connector member 14. The use of more stakes or protrusions is certainly possible, and perhaps, desirable in the event that the connector 10 will be large in size and weight and will be connected and disconnected with a great deal of frequency. It has been found, however, that two stakes or protrusions 96 and 98 are sufficient to hold the hollow dielectric plug 68 in position for light weight, low cost applications. As an example, the connector 10 designed particularly for automobile applications where weight must be kept to an absolute minimum may be constructed of zinc alloy die cast material with an outer diameter of approximately $\frac{3}{8}''$.

Referring to FIGS. 1 and 1*a*, the resilient retaining means 52 or 52*a* can either be a resilient O-ring positioned in interference fit on the outer surface of the mating end 20 of the second connector member 14 in abutment with a shoulder 100 or a resilient washer 52*a* in interference fit within the opening 18 of the mating end 16 of the first connector member 12 in abutment with the inner rear wall 82. It will be appreciated that for applications utilizing the resilient O-ring 52, the end 102 of the mating end 16 of the first connector member 12 will make contact with the resilient O-ring 52 when the mating end 20 of the second connector member 14 has been fully inserted into the opening 18 in the mating end 16 of the first connector member 12. It will also be appreciated that for applications utilizing the resilient washer 52*a*, the end 94 of the mating end 20 of the second connector member 14 will make contact with the resilient washer 52*a* when the mating end 20 of the second connector member 14 has been fully inserted into the opening 18 in the mating end 16 of the first connector member 12. Accordingly, the resilient O-ring 52 or the resilient washer 52*a* provides an indexing means giving a non-visual, tactile indication of full insertion of the mating end 20 of the second connector member 14 into the opening 18 in the mating end 16 of the first connector member 12 following axial mating engagement thereof after which the connector members may be moved rotationally into locked engagement.

Considering the resilient O-ring 52 and the resilient washer 52*a* once again, the latter form of resilient contact or retaining means has the advantage that it is internally disposed. This makes any inadvertent loss thereof far less likely particularly since the shoulder 26 provides a restriction hindering its removal. The only requirement for the resilient retaining means 52 or 52*a* is that it resist forces such as vibration which might tend to move the first and second connector members 12 and 14 out of locked engagement. This is particularly critical in the automobile industry and other applications in which the connector would be subjected to vibrations. In any event, the resilient retaining means 52 and 52*a* also renders the connector 10 weatherproof by providing a seal prohibiting the entry of external contaminants such as dust, dirt and moisture when the first and second connector members 12 and 14 are in locked engagement.

Referring again to FIG. 1, the spring contact 60 preferably is comprised of a pair of leaf contact members 60*a* and 60*b*. The leaf contact members 60*a* and 60*b* are suitably dimensioned so as to maintain the axial alignment of the jaws 66*a* and 66*b* with the openings 70 and 72 and to tightly grip the inner conductors 40 of the cables 36 and 38 within the jaws 66*a* and 66*b*. The leaf-like contacts 60*a* and 60*b* are constructed of a suitable conductive material so as to establish good electrical contact between the inner conductors 40 of the cables 36 and 38 in a manner well known in the art. While they also include flared portions leading into the jaws 66*a* and 66*b* to accommodate any possible misalignment or mispositioning of any of the elements including the inner conductor 40 of the cable 36, the connector 10 is essentially "scoop-proof" due to its design and construction making any misalignment or mispositioning of the inner conductor 40 of the cable 36 during mating engagement of the first and second connector members 12 and 14 unlikely.

In the preferred embodiment, the first connector member or plug 12 includes at least one and preferably two diametrically opposed internal flat shoulders 26. It will also be appreciated that the second connector member or jack 14 will then include two external shoulder accommodating flat surfaces 28 which are diametrically opposed. The second connector member or jack 14 will then also have two external shoulder accommodating circumferential grooves 30 to accommodate the two shoulders 26 of the first connector member or plug 12. It will be appreciated that the external shoulder accommodating circumferential grooves 30 then each extend from one of the two external shoulder accommodating flat surface 28 which serves as an entryway thereto. With these features of construction, the connector 10 provides definite self-alignment and positive locking features making it simple to utilize non-visual, tactile means for accomplishing mating engagement and locked engagement of the first and second connector members 12 and 14.

With the present invention, a connector is provided having both means for orienting connector members 14 mating in engagement and means for securing connector members in locked engagement. This is accomplished by providing structure in which the orientation means provides an entryway leading to the securing means to permit locked engagement of the connector members with the securing means following mating engagement with the orientation means. The connector of the present invention meets the objective of providing a connector having both self-alignment and positive locking features in a single device that can be constructed in a low cost, light weight, weatherproof manner. This is particularly advantageous for in-dash factory installation of Citizens' Band radios in new cars by automobile manufacturers. However, the present invention also finds much broader uses in applications requiring or advantageously utilizing the many advantages enumerated above.

While in the foregoing specification a detailed description of the inventive concepts have been set forth for purposes of illustration, the details herein given may be varied by those skilled in the art without departing from the spirit and scope of the invention set forth and defined by the appended claims. I claim:

1. A connector for joining ends of a pair of cables comprising:

first and second connector members each having a mating end, said mating end of said first connector member having an opening to receive said mating end of said second connector member, said opening being defined by a generally cylindrical inner surface portion of said first connector member and said mating end of said second connector member being defined by a generally cylindrical outer surface portion;

means associated with said mating ends of said first and second connector members for orienting said connector members for mating engagement, said orienting means including a shoulder located on said inner surface portion of said first connector member and a longitudinally extending circumferential interruption located on said outer surface portion of said second connector member;

means associated with said mating ends of said first and second connector members for securing said connector members in locked engagement, said securing means including said shoulder on said inner surface of said first connector member and an annularly extending circumferential groove in said outer surface portion of said second connector member; and means associated with said mating end of one of said connector members providing an environmental seal, said sealing means including a resilient retaining member resisting forces tending to move said connector members out of locked engagement;

said circumferential interruption providing an entryway for said shoulder leading to said circumferential groove to permit locked engagement of said connector members with said shoulder disposed in said circumferential groove following mating engagement of said shoulder with said circumferential interruption.

2. The connector as defined in claim 1 in which the inner diameter of said inner surface portion of said mating end of said first connector member defines a major dimension, said shoulder associated with said inner surface portion of said mating end of said first connector member defines a minor dimension, the outer diameter of said outer surface portion of said mating end of said second connector member defines a major dimension, and said circumferential interruption associated with said outer surface portion of said mating end of said second connector member defines a minor dimension.

3. The connector as defined in claim 2 in which said connector members are adapted for mating engagement when said major and minor dimensions of said first connector member are aligned with said major and minor dimensions of said second connector member.

4. The connector as defined in claim 3 in which said circumferential groove extends from said minor dimension into said major dimension of said outer surface portion of said mating end of said second connector member, said circumferential groove having a depth sufficient to receive said minor dimension of said inner surface portion of said mating end of said first connector member defined by said shoulder.

5. The connector as defined in claim 1 in which said circumferential groove includes an indentation and said shoulder includes a rib, said rib fitting within said indentation when said connector members are in locked engagement, said resilient retaining member resisting forces tending to move said rib out of said indentation.

6. The connector as defined in claim 1 including indexing means providing a nonvisual indication of full insertion of said mating end of said second connector member into said opening in said mating end of said first connector member following mating engagement of said connector members with said shoulder and said circumferential interruption.

7. A connector for joining ends of a pair of cables comprising:

first and second connector members each having a mating end, said mating end of said first connector member having an opening to receive said mating end of said second connector member, said mating ends of said first and second connector members each being defined by an outer surface generally cylindrical in shape, said mating end of said second connector member being dimensioned to fit within said opening in said mating end of said first connector member, said opening in said mating end of said first connector member being defined by an inner surface generally cylindrical in shape, said opening having an inner diameter at least as great as the outer diameter of said mating end of said second connector member;

means associated with said mating ends of said first and second connector members for orienting said connector members for mating engagement;

said orientation means permitting said mating end of said first connector member to receive said mating end of said second connector member only in a preselected position of relative rotation, said orientation means including cooperatively shaped elements associated with said mating ends of said first and second connector members, said cooperatively shaped elements including a projection associated with said mating end of one of said connector members and an axially extending interruption associated with said mating end of the other of said connector members, said projection being a shoulder and said axially extending interruption being a shoulder accommodating surface, said shoulder and said shoulder accommodating surface permitting axial mating engagement of said connector members in at least one preselected position of relative rotation;

means associated with said mating ends of said first and second connector members for securing said connector members in locked engagement;

said securing means including cooperatively shaped elements associated with said mating ends of said first and second connector members, said cooperatively shaped elements including a projection associated with said mating end of one of said connector members and a circumferential interruption associated with said mating end of the other of said connector members, said projection being said shoulder of said orientation means and said circumferential interruption being a shoulder accommodating groove, said shoulder and said shoulder accommodating groove permitting rotational locking engagement of said connector members in at least one preselected position of relative rotation, said shoulder being associated with said inner surface defining said opening in said mating end of said first connector member and said shoulder accommodating surface being associated with said outer surface of said mating end of said second connector member;

said orientation means providing an entryway leading to said securing means to permit locked engagement of said connector members with said securing means following mating engagement with said orientation means.

8. The connector as defined in claim 7 in which said orientation means prevents rotational locking engagement of said connector members until full insertion of said mating end of said second connector member into said opening in said mating end of said first connector member following axial mating engagement of said connector members with said orientation means.

9. The connector as defined in claim 8 in which said entryway is defined by said shoulder accommodating surface which terminates in and communicates with said shoulder accommodating groove, said shoulder accommodating groove being longitudinally positioned to permit rotational locking engagement only after full insertion following axial mating engagement.

10. The connector as defined in claim 7 in which said inner diameter of said opening in said mating end of said first connector member defines a major dimension and said shoulder associated with said opening in said mating end of said first connector member defines a minor dimension.

11. The connector as defined in claim 10 in which said outer diameter of said mating end of said second connector member defines a major dimension and said shoulder accommodating surface associated with said mating end of said second connector member defines a minor dimension.

12. The connector as defined in claim 11 in which said connector members are adapted for mating engagement when said major and minor dimensions of said first connector member are aligned with said major and minor dimensions of said second connector member.

13. The connector as defined in claim 12 in which said shoulder accommodating groove extends circumferentially from said minor dimension portion into said major dimension portion of said mating end of said second connector member, said groove having a depth sufficient to receive said minor dimension portion of said mating end of said first connector member defined by said shoulder.

14. The connector as defined in claim 7 in which said securing means includes resilient retaining means associated with said mating end of one of said connector members, said resilient retaining means resisting forces tending to move said connector members out of locked engagement.

15. The connector as defined in claim 14 in which said shoulder accommodating groove includes an indentation and said shoulder includes a rib, said rib fitting within said indentation when said connector members are in locked engagement, said resilient retaining means resisting forces tending to move said rib out of said indentation.

16. The connector as defined in claim 7 including indexing means providing a non-visual indication of full insertion of said mating end of said second connector member into said opening in said mating end of said first connector member following mating engagement of said connector members with said orientation means.

17. A connector for joining ends of a pair of coaxial cables each having an inner conductor surrounded by an insulating layer, an outer conductor, and an insulating jacket, said connector comprising:

first and second connector members each having a conductive body, said bodies of said first and second connector members each having a mating end and a cable receiving end;

said cable receiving end of said first connector member being adapted to receive said end of said inner conductor of one of said cables in electrical isolation therefrom and said mating end of said first connector member having an opening to receive said mating end of said second connector member;

said cable receiving end of said second connector member being adapted to receive said end of said inner conductor of the other of said cables in electrical isolation therefrom and said mating end of said second connector member having an opening to communicate with said cable receiving end of said first connector member;

means for electrically connecting said ends of said inner conductors of said pair of coaxial cables in electrical isolation from said bodies of said first and second connector members;

said inner conductor electrical connection means including a spring contact disposed in said opening in said mating end of said second connector member, said contact having axially aligned jaws at opposite ends thereof;

means for electrically connecting said ends of said outer conductors of said pair of coaxial cables in electrical contact with said bodies of said first and second connector members;

means associated with said mating ends of said first and second connector members for orienting said connector members for mating engagement; and means associated with said mating ends of said first and second connector members for securing said connector members in locked engagement;

said securing means permitting locked engagement of said connector members only after said mating end of said second connector member has been fully inserted into said opening in said mating end of said first connector member following mating engagement of said connector members with said orientation means.

18. The connector as defined in claim 17 in which said cable receiving ends of said first and second connector members communicate with the corresponding one of said mating ends.

19. The connector as defined in claim 17 in which said cable receiving ends of said first and second connector members each include means for securing the corresponding one of said ends of said pair of cables to be joined.

20. The connector as defined in claim 17 in which said inner conductor electrical connection means further includes a hollow dielectric plug disposed in said opening in said mating end of said second connector member, said spring contact being disposed within said dielectric plug in electrical isolation from said bodies of said first and second connector members.

21. The connector as defined in claim 20 in which said dielectric plug has axially aligned openings in opposite ends thereof, said openings in said ends of said dielectric plug also being axially aligned with said jaws of said spring contact.

22. The connector as defined in claim 21 in which said cable receiving ends of said first and second connector members have bores therethrough, said bores each being dimensioned to receive said inner conductor and said insulating layer of one of said ends of said pair of coaxial cables to be joined.

23. The connector as defined in claim 22 in which said inner conductors associated with said connector members extend into said openings in said mating ends thereof, said inner conductor associated with said second connector member being gripped by one of said jaws of said spring contact, and said inner conductor associated with said first connector member being releasably gripped by the other of said jaws of said spring contact after full insertion of said mating end of said second connector member into said opening in said mating end of said first connector member.

* * * * *